United States Patent [19]

Morcheles

[11] Patent Number: 4,467,924

[45] Date of Patent: Aug. 28, 1984

[54] MOVABLE AISLE STORAGE SYSTEM

[75] Inventor: Bernard I. Morcheles, Short Hills, N.J.

[73] Assignee: Stacor Corporation, Newark, N.J.

[21] Appl. No.: 300,306

[22] Filed: Sep. 8, 1981

[51] Int. Cl.[3] ..... A47B 53/00

[52] U.S. Cl. ..... 211/1.5; 104/287; 105/29 R; 238/134; 238/151; 312/198

[58] Field of Search ..... 211/1.5, 162, 151; 312/198, 199, 200, 201; 105/29 R; 104/146, 248, 287; 238/8, 134, 143, 122, 175, 231, 151

[56] References Cited

U.S. PATENT DOCUMENTS

| | | | |
|---|---|---|---|
| 860,923 | 7/1907 | Lawrence | 238/231 X |
| 1,482,638 | 2/1924 | Fergusson | 238/231 X |
| 1,603,393 | 10/1926 | Malcolm | 104/248 |
| 2,166,704 | 7/1939 | Foulkes | 312/198 X |
| 2,803,088 | 8/1957 | Swann | 46/29 X |
| 2,915,195 | 12/1959 | Crosby | 312/201 X |
| 3,774,547 | 11/1973 | Widiger | 238/134 X |
| 3,923,354 | 12/1975 | Young | 312/198 X |
| 3,957,323 | 5/1976 | Tucker et al. | 312/198 |
| 4,017,131 | 4/1977 | Camenisch | 312/198 |
| 4,256,355 | 3/1981 | Yamaguchi et al. | 312/198 |

FOREIGN PATENT DOCUMENTS

| | | | |
|---|---|---|---|
| 696130 | 10/1964 | Canada | 312/199 |

*Primary Examiner*—Ramon S. Britts
*Assistant Examiner*—Robert W. Gibson, Jr.
*Attorney, Agent, or Firm*—Robert A. Maikis

[57] ABSTRACT

A movable aisle storage system is provided having rail and panel connector units which perform the dual functions of forming the rails and interconnecting the deck panels of the system track and deck assembly. Each connector unit has a substantially cylindrical rail portion and a depending support portion having a pair of upwardly and outwardly extending flange sections which support and secure the sides of the deck panels. Levelling screws threadedly engaging the unit support portion are seated in a channel to facilitate system installation and prevent floor damage. Flexible seal strips are used between the rails and panels thereby reducing system maintenance and permitting access to the levelling screws after system installation. Rail sections are joined to form an extended track by a self-tightening rail section joiner having a pair of tapered head machine screws which threadedly engage holes in abutting rail sections. A joiner member overlies the rail section holes and has openings to receive the screws. The member openings have a center-to-center distance less than the center-to-center distance of the section holes so that rotation of the screws causes the section ends to be forced together tightly. An anti-tip bar may be secured to a movable carrier so that a substantially cylindrical bore in the bar slidably receives a rail and prevents carrier tipping. A wheel and housing assembly for the movable carriers having an axle, a wheel and two interchangeable support members is assembled with a simple peening operation.

17 Claims, 29 Drawing Figures

FIG. 22
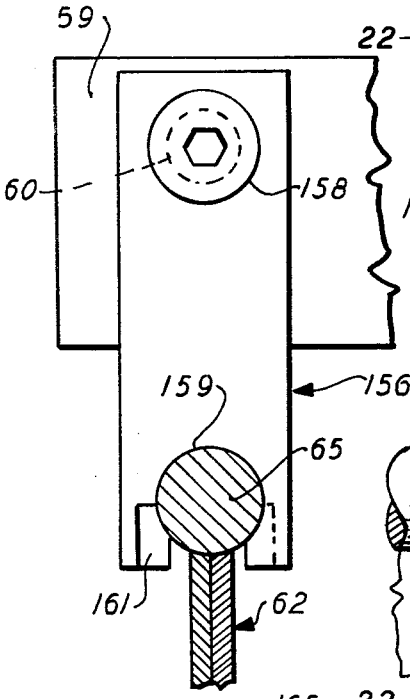
FIG. 21
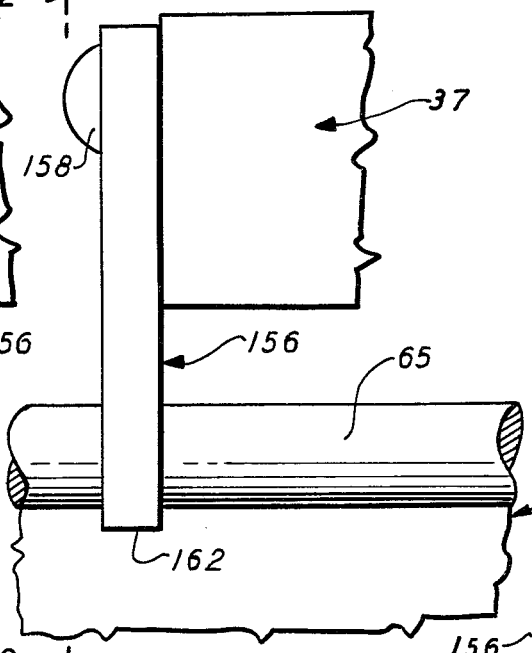
FIG. 19
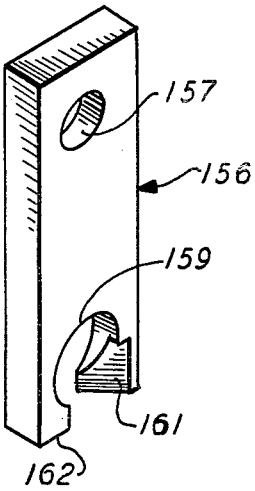
FIG. 20
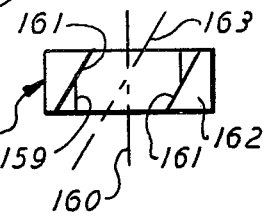
FIG. 23
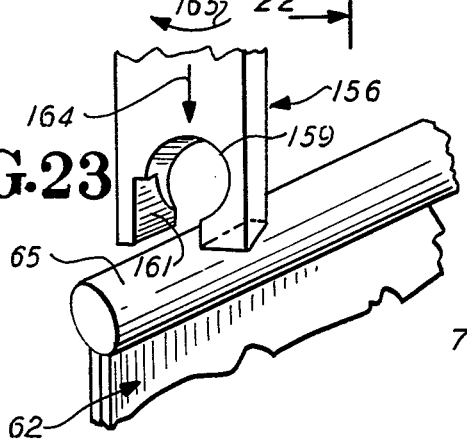
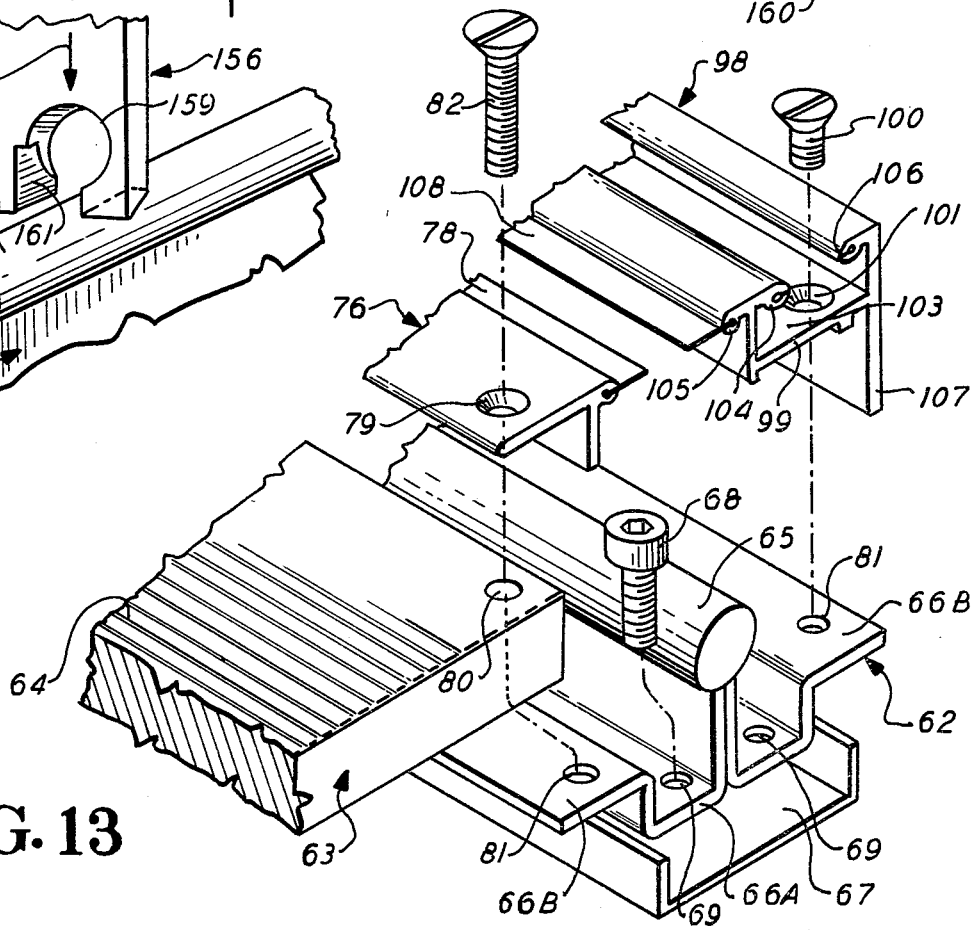
FIG. 13

FIG. 29
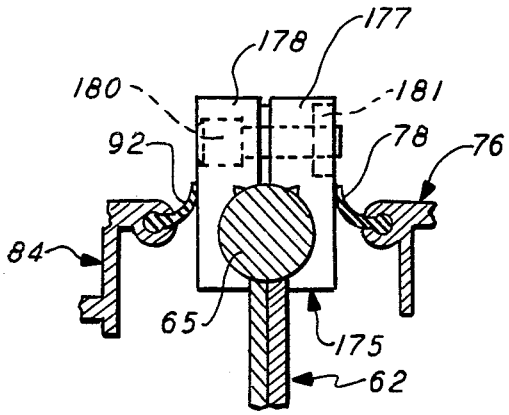
FIG. 26
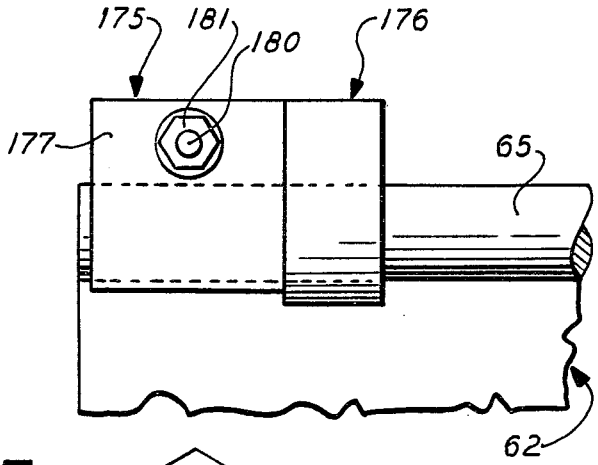
FIG. 27
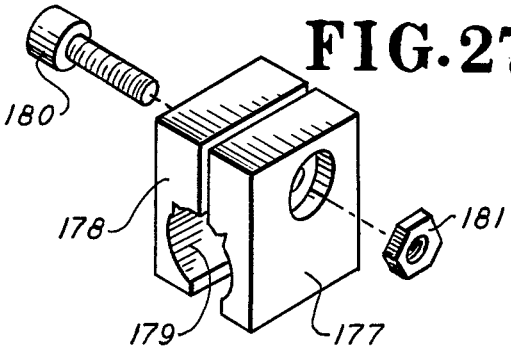
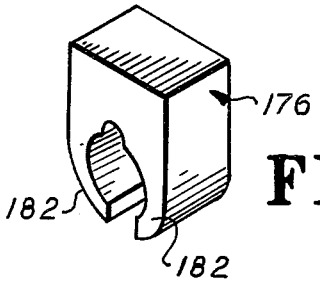
FIG. 28
FIG. 24
FIG. 25
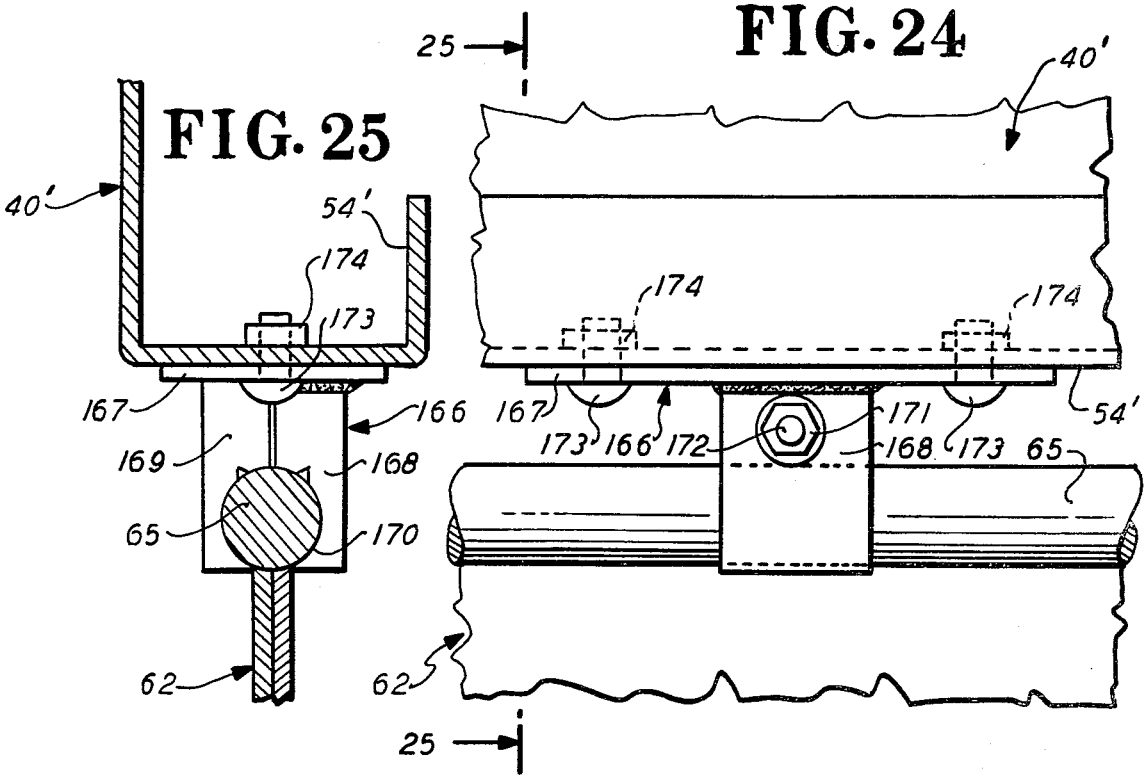

MOVABLE AISLE STORAGE SYSTEM

BACKGROUND OF THE INVENTION

1. Field of the Invention

This invention relates to high density storage systems for records, books, files, parts and the like and more particularly to an improved movable aisle storage system.

2. Description of the Prior Art

Because of high rent costs and other factors, there is a great demand for high density storage systems which offer maximum storage space and require only a minimum floor area. When storage equipment, such as shelves, bins and cabinets, for example, are arranged in rows sufficient aisle space must be provided between adjacent rows to permit access to the stored material. Since most of the aisle space is not in use at a given time, movable aisle storage systems have been developed which provide aisle space between adjacent rows of storage equipment only when that space is actually needed thereby substantially reducing the overall floor area required for the system. To accomplish this, a row of storage equipment, such as the aforementioned shelves, bins, etc. is mounted on a movable carrier having wheels which engage a set of rails which are mounted in a track and deck assembly. The system is so arranged that all of the rows of storage equipment on the movable carriers except one are stacked together so that only a single aisle is provided between the stacked rows and the remaining row. By rolling the appropriate carriers, an aisle may be created between those rows of storage equipment to which access is desired.

The problems encountered by presently known movable aisle storage systems are many and varied. For example, the known systems must usually be installed by skilled workmen especially when the floor on which the track and deck assembly is located is not perfectly level or where sections of rail must be joined together to form a long track length for the movable carriers. Additionally, many of the known systems could damage the floor of the building in which the system is installed because grouting or shimming of the rails is required or because the track and deck levelling adjustment screws bear against the floor or because the track and decking must be fastened directly to the building floor. Further, since all floors except concrete slab floors settle and since the loading of the storage equipment may change, the problem of levelling the rails and deck panels after installation and loading of the system arises. In many of the known arrangements, this is difficult if not impossible without unloading and disassembling the system.

With respect to the safety of the employees who must use the system, the rails should be recessed in the track and deck assembly to prevent tripping, deck panels should be adequately supported to prevent bouncing when walked upon and an easily installed anti-tip means be provided to prevent the rows of storage equipment from being accidentally tipped over. Furthermore, many of the known systems require substantial maintenance because of the need to remove debris which accumulates between the rails and the deck panels which form the track and deck assembly. This problem arises because many of the known systems utilize laterally-extending guides which bear against the rails adjacent the carrier wheels to prevent "yawing" of the movable carriers, so that a substantial space is created between each rail and the adjacent deck panels. Finally, it is often difficult to install optional equipment, such as mechanicl drive systems, for example, in the known systems after the initial installation has been completed.

SUMMARY OF THE INVENTION

It is an object of this invention to provide a movable aisle storage system which may be easily assembled by unskilled workmen.

It is a further object of this invention to provide a movable aisle storage system which may be easily installed over floors which are not perfectly level and in which levelling adjustments can be readily made after the installation of the system is completed and the storage equipment loaded.

It is a still further object of this invention to provide a movable aisle storage system in which multiple rail lengths may be easily joined and aligned to form an extended track.

It is an additional object of this invention to provide a movable aisle storage system which will not damage the floor of the building in which the system is installed and which requires no fastening of the track and deck assembly to the building floor.

It is another object of this invention to provide a movable aisle storage system having a unique rail and panel connector unit which serves the dual functions of forming the rails and of joining adjacent deck panels.

It is an additional object of this invention to provide a movable aisle storage system meeting the safety requirements of recessed rails, easily installed anti-tip means and deck panels supported to substantially prevent panel bounce.

It is another object of this invention to provide a movable aisle storage system having extremely low maintenance requirements because of the elimination of spaces between the rails and adjacent deck panels made possible by a unique anti-yawing design of the carrier wheel and rails.

It is an additional object of this invention to provide a movable aisle storage system which is mechanically rugged and trouble-free in operation and which readily permits the installation of optional equipment, such as mechanical drives, for example, after initial installation of the system is complete.

It is a further object of this invention to provide a movable aisle storage system having a wheel and housing assembly for the movable carriers thereof which is easily manufactured and installed.

It is another object of this invention to provide a unique, self-tightening rail section joiner for movable aisle storage systems of the type having multiple rail sections to be joined.

It is an additional object of this invention to provide a unique, anti-tip device for twist-action installation in movable aisle storage systems of the type having substantially cylindrical rails.

Briefly, the movable aisle storage system of the invention comprises at least one deck panel and a pair of rail and panel connector units disposed on opposite sides of the panel and extending along the length thereof. Each connector unit has a substantially cylindrical rail portion and a support portion depending from the rail portion for support thereof. The support portion has a pair of upwardly and outwardly disposed flange sections extending therefrom. Each flange section is adapted to support one side of a deck panel thereon. Means are provided for securing each side of the deck panel to the adjacent flange section of the connector unit associated with that side. At least one movable carrier adapted to support storage equipment thereon is provided and has wheels engaging the connector unit rail portions for rolling movement therealong. The connector unit support portion may have a support section shaped substantially as an inverted tee. A longitudinally-extending levelling channel is disposed beneath each connector unit with the web of the channel adapted to abut the floor on which the system is located and the arms of the inverted tee support section are seated between the flanges of the channel so that the weight of the system is borne by the connector units and transmitted through the channel to the floor. Levelling screws threadedly engage the inverted tee arms and the ends of the screws bear against the channel web. Yawing of the carriers is prevented by making the curvature of the carrier wheel races substantially the same as the curvature of the connector unit rail portion so that the need for known types of anti-yaw systems is eliminated and flexible seal strips may be provided to seal the space between the rail portion and the adjacent deck panels. The flexible seal strips permit access to the levelling screws after system installation is completed and the system loaded.

A self-tightening rail joiner is provided for joining the ends of two sections of rail of the type having an inverted tee-shaped support member with oppositely-disposed, threaded holes adjacent the section ends. The joiner has a pair of tapered head machine screws which threadedly engage the section holes and a member adapted to overlie the section holes. The member has a pair of openings therethrough adapted to receive the machine screws and having a center-to-center spacing which is less than the center-to-center spacing of the section holes. The member openings have a lateral width greater than the longitudinal length thereof so that only the laterally-extending rims of the openings engage the tapered head of the screws whereby rotation of the screws causes the rail section ends to be forced together tightly.

An anti-tip device is provided comprising a member having a substantially cylindrical bore extending therethrough along a first axis and a channel opening from a bar end to the bore to bifurcate the member. The bore has a diameter of sufficient size to permit a substantially cylindrical rail to slide therethrough and the channel extends along a second axis which is disposed at an acute angle with respect to the first axis. Means are provided for mounting the member on a movable carrier so that the first axis of the bore is substantially coincident with the longitudinal axis of the rail whereby the member is adapted to be placed on the rail by aligning the second axis of the channel with the rail axis, seating the rail in the bore and twisting the member to align the first axis of the bore with the rail axis.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 13 is an exploded perspective view showing a rail and panel connector unit connecting a deck panel to a rear panel molding for the track and deck assembly;

FIG. 19 is a perspective view of an anti-tip device constructed in accordance with the teachings of the invention;

FIG. 20 is a bottom plan view of the anti-tip device of FIG. 19;

FIG. 21 is a side elevational view of a portion of a movable carrier and adjacent rail showing the anti-tip device mounted on the carrier and engaging the rail;

FIG. 22 is an end elevational view, partly in section, taken along the line 22—22 of FIG. 21;

FIG. 23 is a perspective view of a portion of the anti-tip device and a rail showing how the device is placed on the rail;

FIG. 24 is a side elevational view of a portion of a fixed end carrier and adjacent rail showing how the carrier is mounted on the rail;

FIG. 25 is a full sectional view taken along the line 25—25 of FIG. 24 of the drawings;

FIG. 26 is a side elevational view showing an end stop and an end stop bumper mounted on the end of a rail in lieu of a fixed carrier;

FIG. 27 is an exploded perspective view of the end stop of FIG. 26;

FIG. 28 is a perspective view of the end stop bumper of FIG. 26; and

FIG. 29 is an end elevational view, partly in section, showing the end stop on the rail together with the adjacent deck panel moldings and seal strips.

DESCRIPTION OF THE PREFERRED EMBODIMENT OF THE INVENTION

Figure 1:
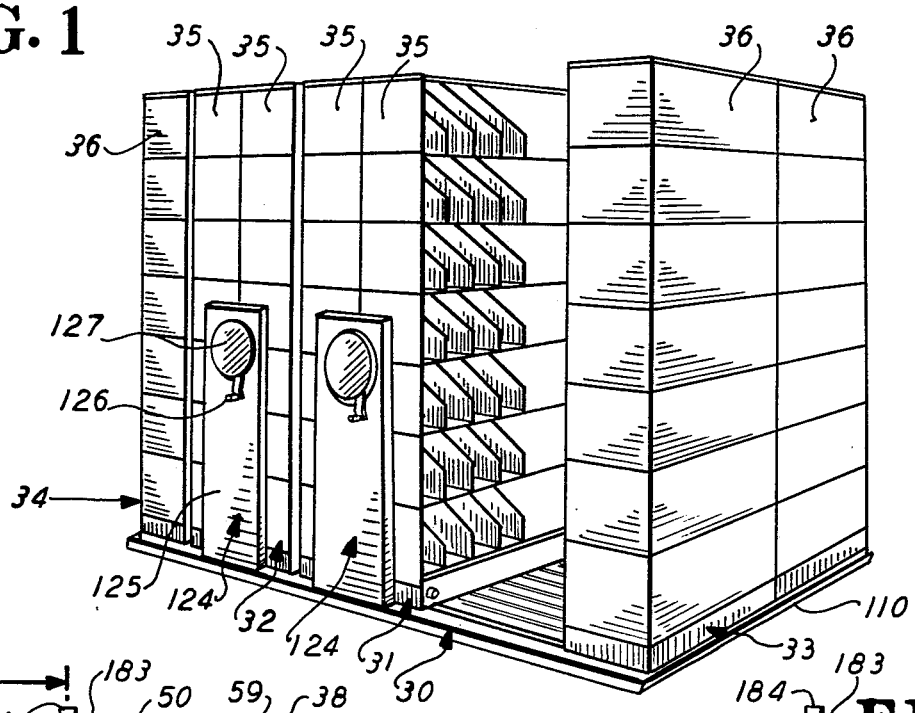
FIG. 1 is a perspective view of a movable aisle storage system constructed in accordance with the teachings of the present invention.

Referring now to FIG. 1 of the drawings, there is shown a movable aisle storage system constructed in accordance with the teachings of the present invention comprising a track and deck assembly, indicated generally as 30, two movable carriers, indicated generally as 31 and 32, and two fixed end carriers, indicated generally as 33 and 34. Each of the movable and fixed carriers is designed to support storage equipment, such as the compartmented shelving illustrated, for example. It will be understood, however, that other types of storage equipment such as plain shelving, bins, drawers and cabinets could be substituted for the compartmented shelving if desired. Since the shelving is usually sold in sections of fairly standardized size, the movable and fixed carriers are designed to accomodate a specific number of sections of shelving. Since the weight of the shelving and the weight of the material stored on the shelving is transmitted through the carriers to the rails of the track and deck assembly, it follows that the larger the number of sections on a carrier the larger the number of rails required for adequate support of the system. For example, in the system illustrated, three rails are utilized in the track and deck assembly and each of the movable carriers 31 and 32 is designed to receive four sections 35 of shelving while each of the fixed end carriers 33 and 34 is designed to receive two sections 36 of shelving. For a four rail system, each movable carrier might receive six sections of shelving and so on.

Figure 2:
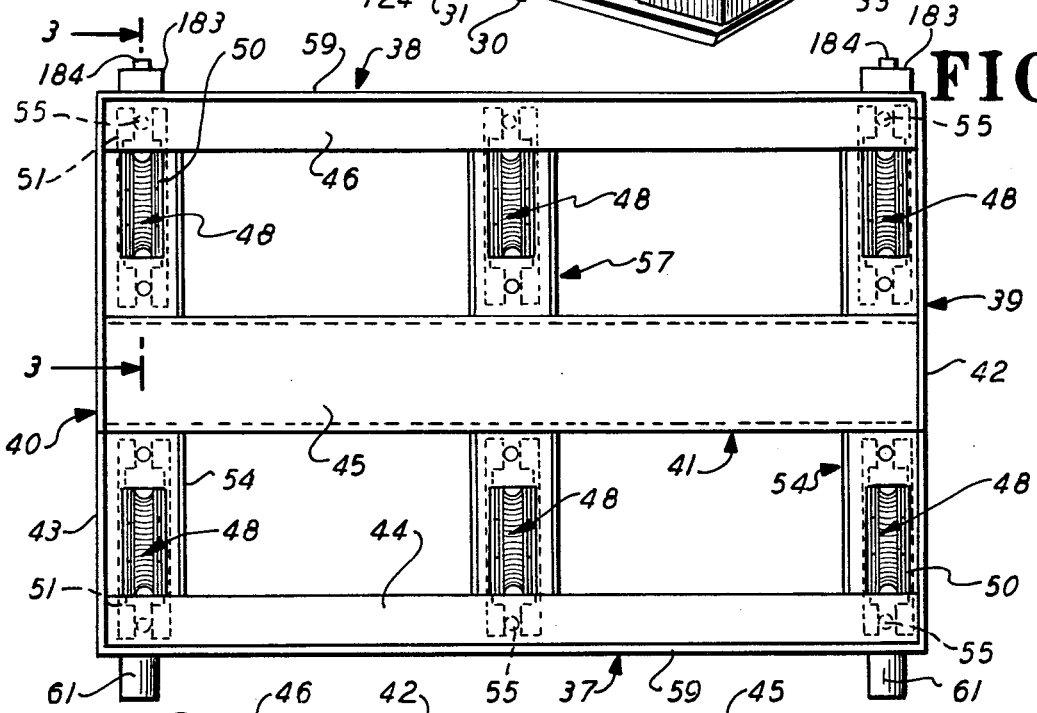
FIG. 2 is a top plan view of one of the movable carriers shown in FIG. 1 of the drawings.
Figure 3:
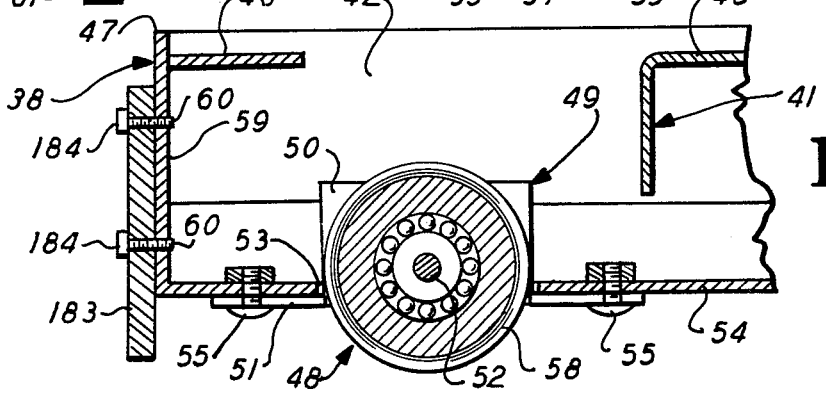
FIG. 3 is a full sectional view taken along the line 3—3 of FIG. 2 showing details of the movable carrier and a wheel and housing assembly.
Figure 4:
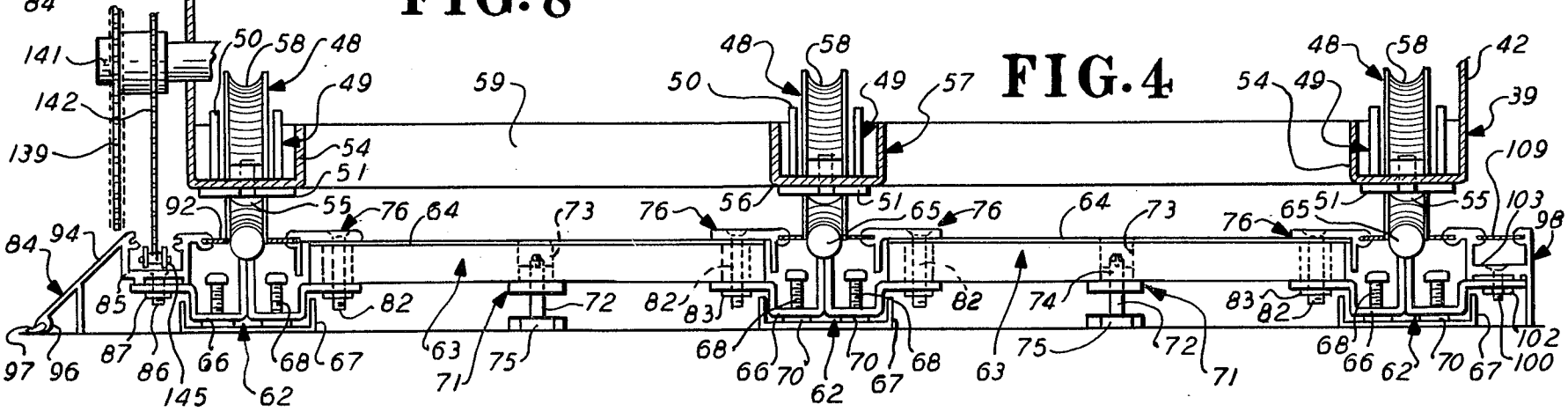
FIG. 4 is an end elevational view of the track and deck assembly of the storage system showing a movable carrier thereon with one of the end frame members of the carrier omitted to reveal details of construction.

The construction of the movable carriers 31 and 32 is shown in FIGS. 2, 3 and 4 of the drawings wherein it is seen that each carrier comprises two channel-shaped end members, indicated generally as 37 and 38, which are secured by means such as welding, for example, to two J-shaped side members, indicated generally as 39 and 40, to form a substantially rectangular frame. A channel-shaped support member, indicated generally as 41, is welded to the web portion 42 of side member 39 and the web portion 43 of side member 40 to further strengthen the frame and provide a greater load bearing surface for the sections 35 of shelving. The upper flange portion 44 of end member 37, the web portion 45 of the channel 41 and the upper flange portion 46 of the end member 38 combine to form the load bearing surface for the sections of shelving. The web portion of each of the frame members 37, 38, 39 and 40 is provided with an upwardly-extending lip 47 to prevent horizontal sliding movement of the shelving sections 35. In practice, the shelving sections 35 are usually not secured to the movable carriers 31 and 32 unless the anti-tip device of the invention is utilized because the weight of the shelving is usually sufficient to hold it in place.

Figure 6:
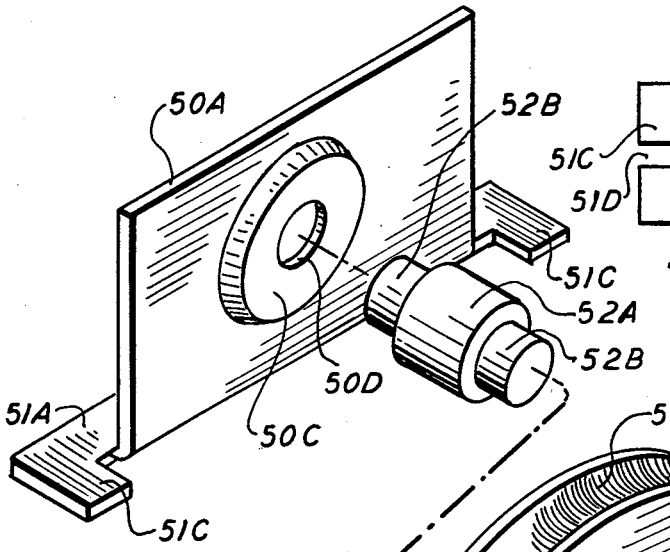
FIG. 6 is a top plan view of the wheel and housing assembly of FIG. 5.
Figure 6:
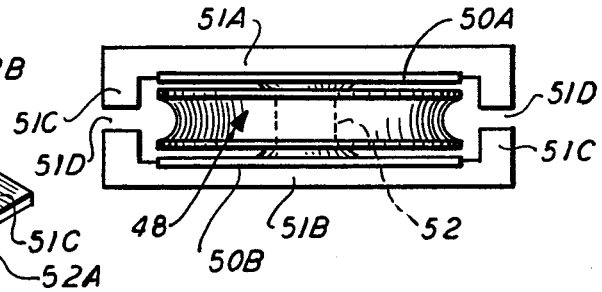
Figure 5:
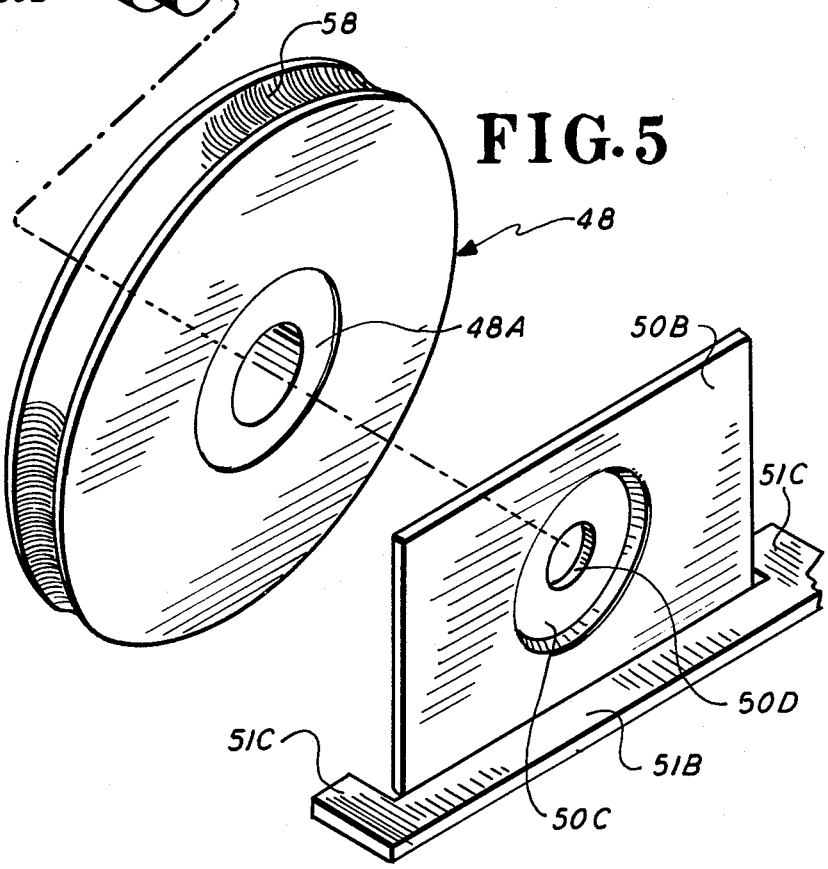
FIG. 5 is an exploded perspective view of one of the wheel and housing assemblies of the movable carriers.
Figure 7:
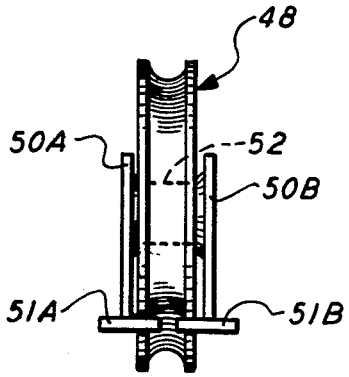
FIG. 7 is an end elevational view of the wheel and housing assembly of FIG. 5.
Figure 9:
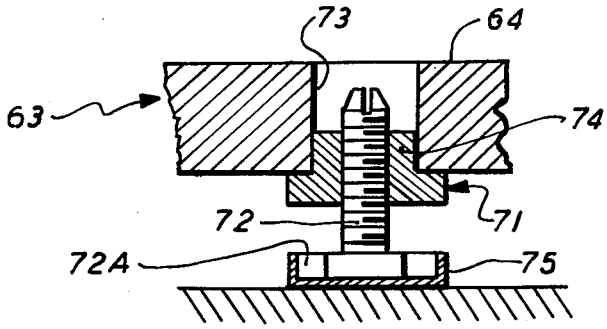
FIG. 9 is an enlarged side elevational view, partly in section, of one of the deck panel levelling screws shown in FIGS. 4 and 8.
Figure 10:
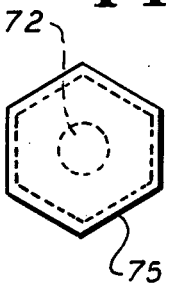
FIG. 10 is a bottom plan view of the deck panel levelling screw shown in FIG. 9.

Each movable carrier is provided with six wheels, indicated generally as 48, which engage the three rails of the illustrated system. Each wheel is disposed in a wheel housing, indicated generally as 49, which has a vertically-extending support portion 50 and a horizontally-extending flange portion 51. The detailed construction of the wheel housing 49 is shown in FIGS. 5, 6 and 7 of the drawings wherein it is seen that the support portion 50 is formed by a pair of oppositely-disposed, rectangular support plates 50A and 50B which are each formed with an inwardly extending boss 50C thereon. Each of the bosses 50C is provided with a circular opening 50D which serves to support an end of an axle, indicated generally as 52, upon which the wheel 48 is mounted. The wheel 48 is provided with an annular ball bearing 48A which is seated on an enlarged shoulder portion 52A of the axle. The flange portion 51 of the wheel housing comprises oppositely-disposed, C-shaped flange plates 51A and 51B. Each flange plate has a pair of inwardly-extending legs 51C at the ends thereof which cooperate with the corresponding legs on the other flange plate to form open-ended slots 51D therebetween.

The vertically-disposed support plate 50A and the horizontally-disposed flange plate 51A may be conveniently fabricated from a single sheet of a suitably heavy-gauge steel to provide an integral member and to eliminate the expensive cast iron wheel housing found in some prior art systems. The plates 50B and 51B which form the other side of the wheel housing may be fabricated in the same manner since it is a piece of identical shape and size. The novel construction disclosed herein also permits easy assembly of the wheel and wheel housing. To this end, the wheel 48 is placed on the axle 52 so that the bearing 48A is seated on the axle shoulder 52A. The smaller diameter ends 52B of the axle 52 are then inserted in the openings 50D of the support plates 50A and 50B and the projecting ends of the axle are peened over to anchor the axle firmly in place with respect to the two wheel housing members.

As seen in FIG. 7, the housing members and the wheel are so proportioned that the wheel 48 projects a distance below the flange portion 51 of the wheel housing. Four of the wheel and housing assemblies are disposed on opposite sides of the movable carrier and are seated in slots 53 which are formed in the lower flange portion 54 of each of the J-shaped frame members 39 and 40. The flange portion 51 of each of these housing assemblies is secured by bolts 55 to the flange portion 54 of the members 39 and 40. As seen in FIGS. 2 and 3, the bolts 55 pass through the open-ended slots 51D which are formed by the ends 51C of the flange plates 51A and 51B of the wheel housing members. This arrangement permits the wheel and housing assembly to be easily installed on the movable carrier frame since it is not necessary to align the bolts 55 with small bolt holes in each of the flange portions of the wheel housing as found in prior art arrangements. The present system permits the bolts 55 to be loosely secured to the carrier frame before the housing assembly is put in place. The open-ended slots 51D permit the housing assembly to be slid into place from either direction with respect to the bolts 55 but prevent a yawing or rotational movement of the wheel and housing assembly with respect to the movable carrier frame so that the wheels 48 are rigidly aligned with respect to the rails of the system. After the housing assemblies are slid into place, the bolts 55 are tightened. The two remaining wheel and housing assemblies are similarly secured to the web portion 56 of an inverted channel member, indicated generally at 57, which is welded to the end members 37 and 38 of the movable carrier frame at points which are midway between the sides of the carrier.

In practice, the members of the movable carrier frame may be fabricated of a heavy-gauge steel to provide a strong, mechanically-rugged assembly. The wheels 48 are preferably provided with an outer race 58 which is grooved to conform to the profile of the rail for reasons hereinafter explained. The ball bearing assembly 48A has a good grade of steel ball bearings and is permanently lubricated and sealed. The opposite ends of the web portion 59 of each of the channel members 37 and 38 are provided with a pair of vertically-disposed bolt holes 60 to permit rubber bumpers 61 and other members, as hereinafter explained, to be secured to the movable carrier.

Figure 8:
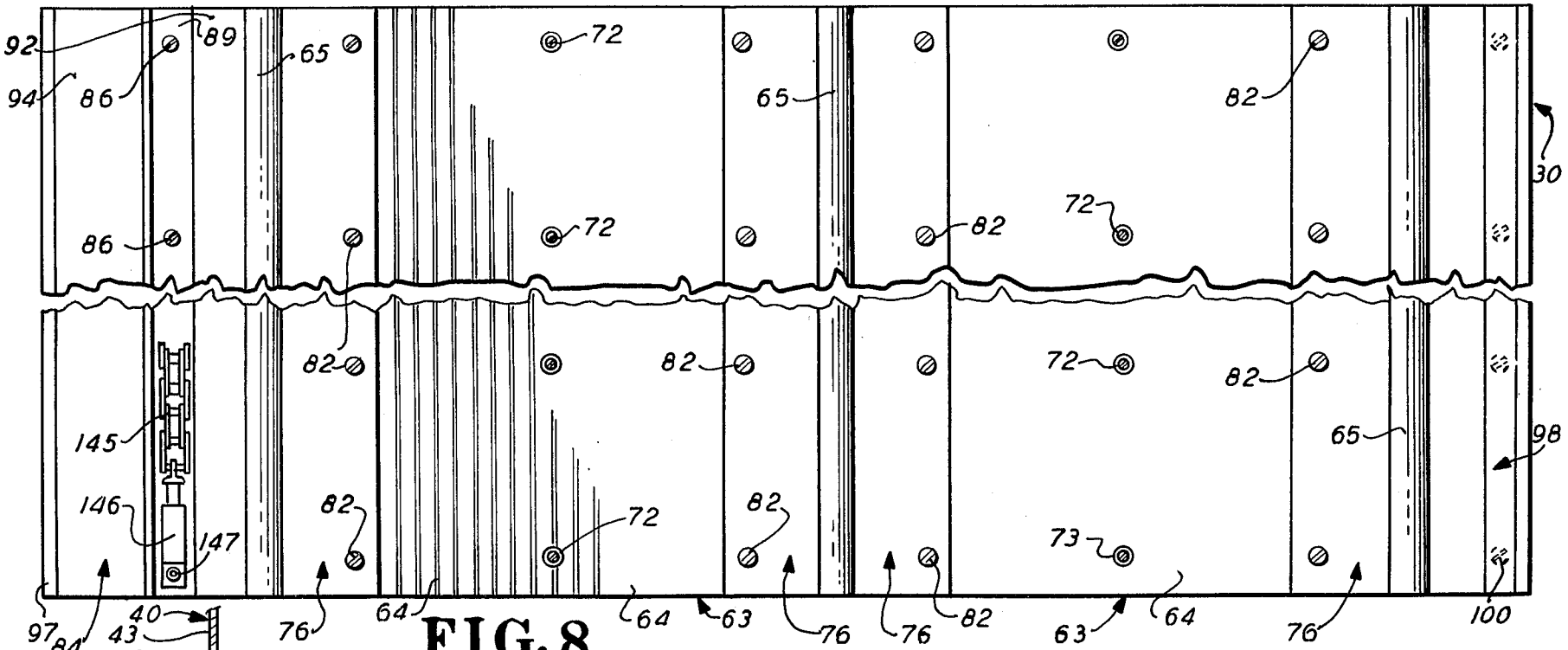
FIG. 8 is a top plan view of the track and deck assembly which has been foreshortened for convenience of illustration.
Figures 11, 12:
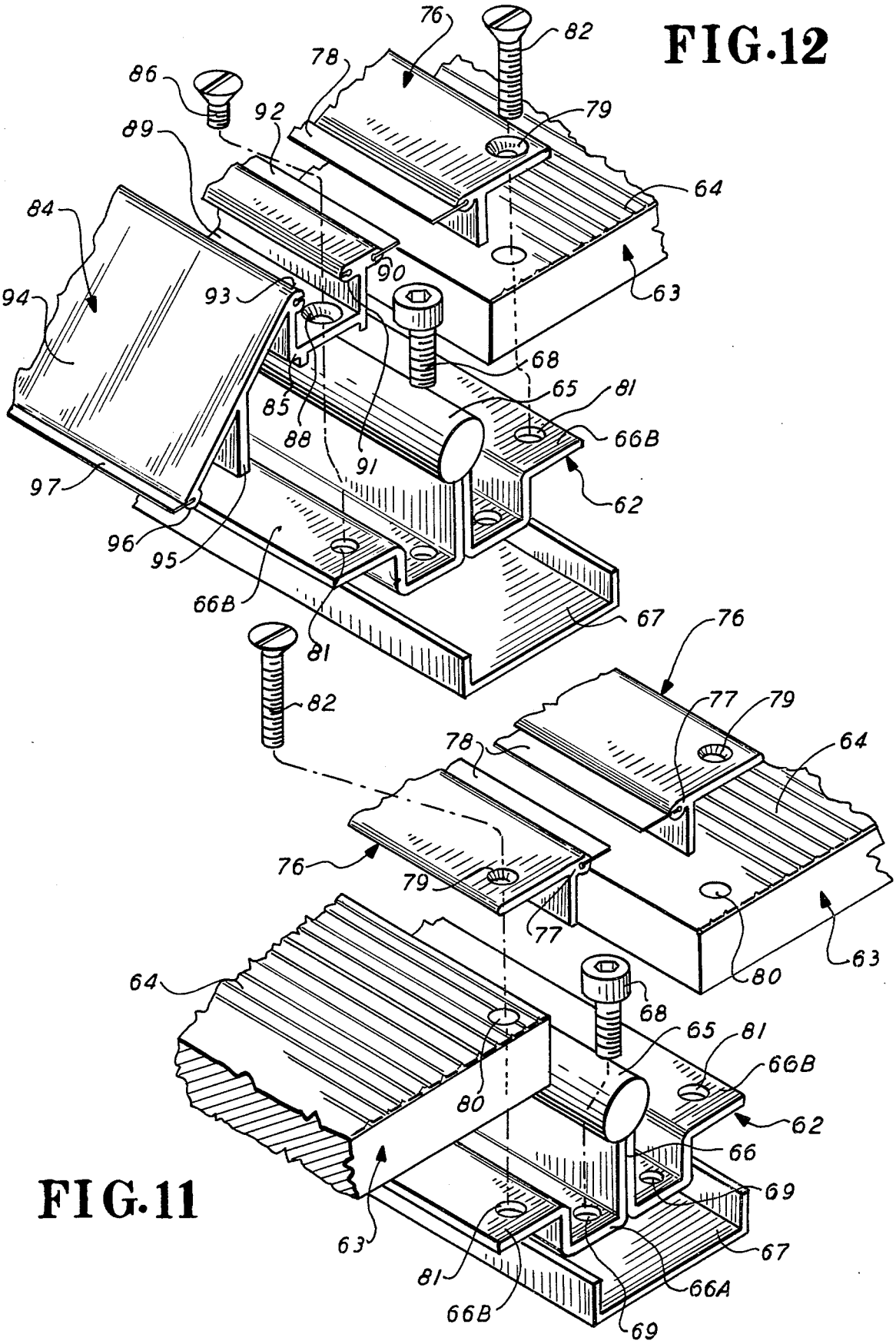
FIG. 11 is an exploded perspective view showing a rail and panel connector unit constructed in accordance with the teachings of the invention interconnecting adjacent deck panels.
FIG. 12 is an exploded perspective view showing a rail and panel connector unit of the invention connecting a deck panel to a front panel molding for the track and deck assembly.

The track and deck assembly 30 is shown in FIGS. 4 and 8 through 13 of the drawings wherein it is seen that three rail and panel connector units, indicated generally as 62, are provided to form the three rails of the assembly and to join two deck panels, indicated generally as 63. The deck panels are preferably formed of an exterior grade of plywood or particle board and are provided with a top surface 64 of a non-slip material, such as corrugated vinyl, for example, to provide a safe walking surface. Each of the three connector units 62 has the same construction and performs the dual functions of forming the rails of the system and joining the deck panels 63. As seen in FIGS. 4, 8 and 11, each connector unit has a substantially cylindrical, longitudinally-extending rail portion 65 and a longitudinally-extending support portion 66 which depends from the rail portion 65 and extends along the length thereof. The support portion 66 of the connector unit has a support section 66A which is shaped substantially as an inverted tee with the web of the tee depending substantially vertically from the rail portion and a pair of upwardly and outwardly extending flange sections 66B upon which the deck panels 63 are supported. Each of the flange sections has a substantially horizontally extending portion for supporting one side of a deck panel thereon to provide vertical load bearing support for the deck panel.

The support section 66A of the connector unit 62 performs the load bearing function for the weight transmitted to the rail 65 through the wheels of the movable carriers 31 and 32. Accordingly, section 66A of the unit is seated in a channel member 67 the web of which abuts the building floor upon which the storage system rests. A pair of levelling screws 68, only one of which is shown in FIG. 11, is disposed in a pair of holes 69 in the arms of the inverted tee-shaped support section 66A of the connector unit and arranged to bear against the levelling channel 67. The levelling screws 68 are preferably Allen head machine screws which threadedly engage a pair of nuts 70 which are welded to the bottom of the support section 66A so that as the levelling screws 68 are rotated, the connector units 62 are raised or lowered with respect to the levelling channel 67. If desired, the holes 69 in the arms of the inverted tee 66A may be threaded to eliminate the nuts 70.

In order to facilitate levelling of the track and deck assembly, each of the connector units 62 is provided with pairs of the levelling screws at intervals of approximately twelve inches along its length. Since the levelling screws bear against the levelling channels 67 rather than against the floor of the building, no damage will be done to the floor by the levelling screws. The levelling channels 67 are preferably made of high strength steel and extend the complete length of the rail and panel connector units 62 associated therewith. Accordingly, the three levelling channels 67 provide substantially flat load bearing surfaces along their lengths which serve to compensate for building floors which are not level themselves. Only when very large out-of-level conditions exist for the building floor will shimming or other level correcting means be required. The storage system of the invention may accordingly be installed by relatively unskilled workers since it is not necessary to use groutt or shims under the rails to secure a level track assembly.

A levelling arrangement is also provided for the deck panels 63. As seen in FIGS. 4 and 8 through 10 of the drawings, deck panel levelling devices comprising propeller nuts, indicated generally as 71, and deck panel levelling screws 72 are seated in holes 73 which extend through the deck panels. The panel levelling devices are arranged in longitudinally-extending rows which are disposed midway between the rails 65. In each row, the devices are spaced about twelve inches apart to facilitate making even very small panel level adjustments. The propeller nuts 71 have a reduced diameter shoulder portion 74 which is seated in the holes 73 with a press fit. The screws 72 have a relatively large flat head 72A which is seated in a protective cap 75 made of a suitable plastic, such as nylon, for example, to prevent damage to the building floor and permit the screws to be easily rotated. The ends of the screws are slotted and are recessed in the holes 73 below the surface 64 of the deck panels for reasons of safety. Since the screw tips are exposed by the holes 73, the may be easily rotated to adjust panel level even after the system is completely installed and fully loaded. This adjustment of panel level prevents the bouncing which occurs when non-level panels are walked upon.

Referring again to FIG. 11 of the drawings which shows the connector unit 62 for the center rail of the system, it will be seen that a pair of longitudinally-extending deck panel moldings, indicated generally as 76, is provided to cover the corners of the panels and to assist in clamping the panels to the flange sections 66B of the connector units. When the deck panels are carpeted, the deck panel moldings also serve to clamp the carpeting in place against the top surface of the panels. Each of the deck moldings 76 is shaped as an angle member and is provided with an outwardly extending lip 77 at the apex of the angle. The lip is split along its length to receive a flexible seal strip 78 which bears against the rail 65 when the molding is in place to prevent debris from falling into the space between the deck panels. Each of the moldings 76 is provided with countersunk screw holes 79 at intervals of approximately twelve inches along the length thereof. These holes are aligned with holes 80 in the deck panels and holes 81 in the support flanges 66B and receive deck molding screws 82 which cooperate with nuts 83 on the underside of the support flanges 66B to hold the panels firmly in place. The holes 80 in the deck panels are enlarges to permit lateral adjustment of the panels. By virtue of this arrangement, the spaces between the deck panels 63 and the rail 65 are completely covered to prevent objects and debris from falling into them. The seal strips 78, however, which may be made of a flexible material, such as rubber, for example, are easily flexed to permit ready access with an Allen head drive tool to the rows of levelling screws 68 which are disposed under the strips, so that levelling adjustments of the track may be made at all times even after the system is completely assembled and loaded with stored material. This is very advantageous since all floors, except concrete slab floors, settle with age and necessitate periodic level adjustments of the track and deck assembly.

The front panel molding, indicated generally as 84, is shown in FIGS. 4 and 12 of the drawings wherein it is seen that the molding extends the length of the associated rail 65 and has a substantially channel-shaped portion 85 which is secured to the flange section 66B of the connector unit 62 by means of a series of spaced, front molding screws 86 and nuts 87. Holes 88 in the front panel molding receive the screws 86. The holes are countersunk and flathead screws are employed to provide a substantially flat recessed surface 89 running the length of the front molding which serves to accomodate a portion of the mechanical drive for the system if such a drive is installed. The flange of the channel-shaped portion 85 nearest the rail 65 is provided with a pair of oppositely-disposed split lips 90 and 91. The lip 90 receives a flexible seal strip 92 which seals the space between the front molding and the adjacent rail 65 to prevent accumulation of debris. Again, this strip may be easily flexed to permit access to the levelling screws 68. The other flange of the channel portion 85 is provided with an inwardly-facing split lip 93 which cooperates with the split lip 91 to receive a sealing strip (not shown) of a suitable plastic, such as vinyl, for example, to completely seal the space 89 when a mechanical drive is not utilized for the storage system. The front molding is completed by a downwardly-sloping apron 94 having a vertically-depending support leg 95 and a split lip 96 which receives a flexible seal strip 97 which bears against the building floor. The seal strips 92 and 97 may be made of a suitable flexible material, such as rubber, for example.

The rear panel molding, indicated generally as 98, is shown in FIGS. 4 and 13 of the drawings wherein it is seen that the molding differs from the front panel molding 84 only in the shape of the apron provided. The rear molding 98 has a channel-shaped portion 99 which is secured to the flange section 66B of the adjacent connector unit 62 by a series of rear molding screws 100 which pass through screw holes 101 in the molding and holes 81 in the flangesection 66B to engage nuts 102 on the underside of the flange. The holes 101 are preferably countersunk and the screws 100 are flathead machine screws so that a substantially flat and level recessed surface 103 is provided in the molding 98 which may be used to receive an element of the mechanical drive in double-ended drive systems as hereinafter explained. The flange of the channel-shaped section 99 which is adjacent the rail 65 is provided with a pair of oppositely-disposed split lips 104 and 105 while the other flange of the section 99 is provided with an inwardly-facing split lip 106 and a vertically-depending apron 107 which closes off the rear of the track and deck assembly 30. The split lip 105 receives a flexible seal strip 108 which bears against the rail 65 and cooperates with seal strip 78 of the adjacent deck panel molding 76 to completely seal the spaces between the rail and the adjacent deck panel and the rear molding. Again, the flexible seal strips 78 and 108 permit access to the levelling screws 68. The split lips 104 and 106 cooperate to receive a sealing strip 109 as shown in FIG. 4 of the drawings which is used when the recessed space 103 is not utilized for a double-ended mechanical drive mechanism as hereafter explained.

If desired, end moldings 110 may be employed to close off the ends of the track and deck assembly as shown in FIG. 1 of the drawings so that all four sides of the assembly are sealed and closed to prevent the accumulation of debris underneath the assembly. This arrangement, together with the various track and molding seals which prevent the accumulation of debris between the rails and adjacent deck panels, greatly minimizes maintenance and promotes worker safety. In practice, the front and rear panel moldings, the deck panel moldings and the end moldings may all be fabricated of extruded aluminum, for example. It will be noted that the use of the track seal strips 78, 92 and 108 is made possible because no side guides, side wheels or other devices which are connected to the movable carriers and disposed adjacent the sides of the rails, such as used in prior art arrangements, are required to prevent yawing of the movable carriers 31 and 32 in the disclosed system of the invention. In the storage system of the invention, yawing is prevented by causing the outer wheel race 58 of each of the movable carrier wheels 48 to have a curvature which is the same as the curvature of the rails 65. When the rails are cylindrical, the curvature of the wheel race is a segment of a circle having substantially the same radius as the rail. If the rails are elliptical in cross section, the curvature of the wheel races would be elliptical and so forth. This arrangement causes each of the carrier wheels to be accurately centered with respect to its associated rail at all times.

Figure 15:
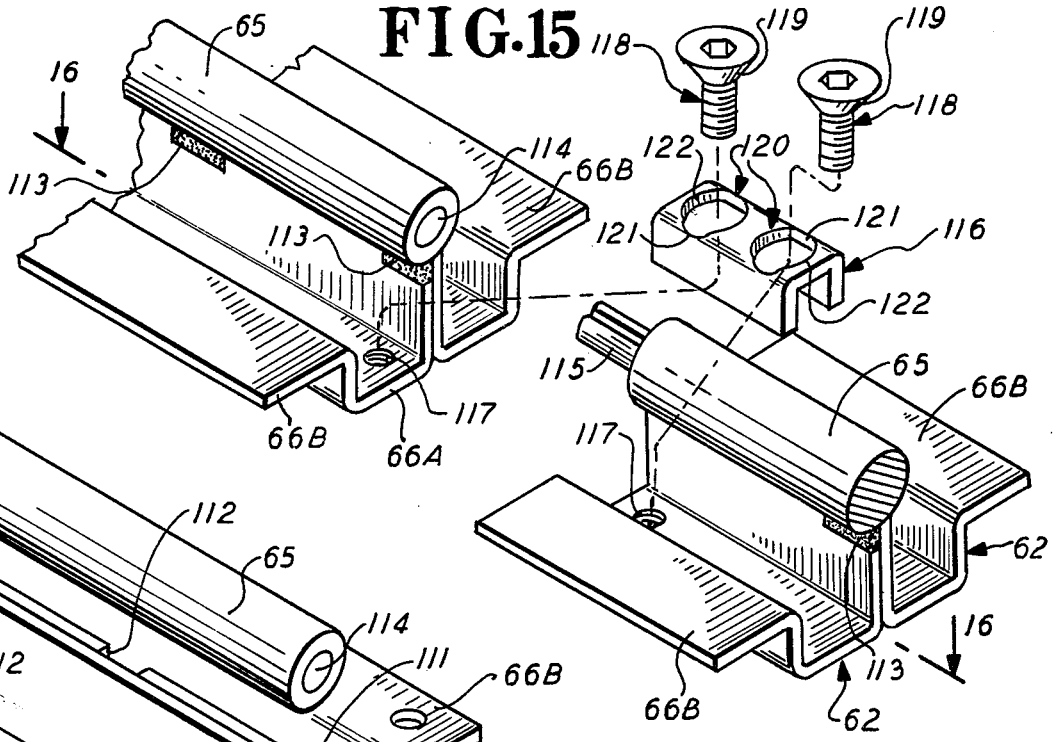
FIG. 15 is an exploded perspective view showing a self-tightening rail section joiner unit of the invention and a pin interconnecting sections of rail to form an extended track.
Figure 14:
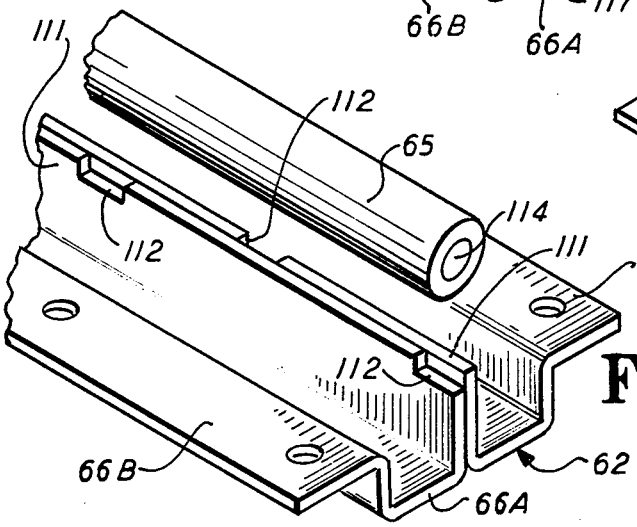
FIG. 14 is an exploded perspective view of the rail and panel connector unit per se showing detailed construction of the unit.
Figure 16:
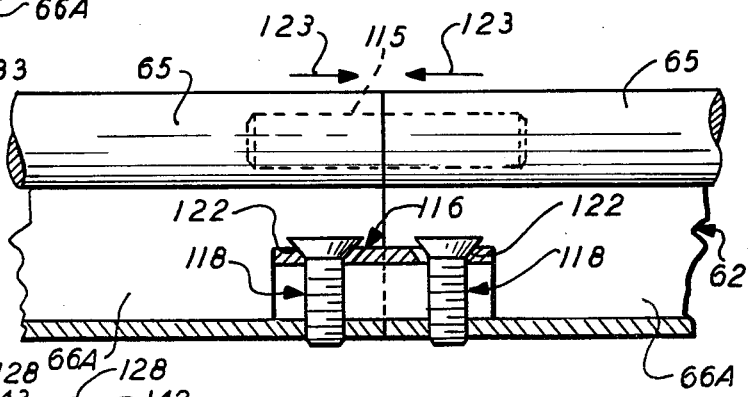
FIG. 16 is a full vertical sectional view taken along the line 16—16 of FIG. 15 of the drawings showing the rail sections connected.

The construction of the rail and panel connector units 62 of the invention is shown in more detail in FIGS. 14, 15 and 16 of the drawings. As seen in FIG. 14, the support portion 66 of the connector unit, which comprises sections 66A and 66B, may be made of two separate members which are joined to each other and also to the rail portion 65 by a single welding operation. To this end, the vertical web 111 of each member is castellated to form a series of openings or slots 112 along the line where the two members meet each other and also the rail portion 65. The series of slots 112 on one of the members is not disposed opposite the series of slots on the other member so that the slots are staggered on opposite sides of the line where the two members meet each other and the rail portion. By virtue of this arrangement, a single welding operation in each of the slots 112 serves to join all three members together as shown in FIG. 15 where the welds are designated as 113. This eliminates the usual two step welding operation which is required to secure three members of this type together. Additionally, the weld material 113 is disposed in the slots 112 so that the rail portion 65 retains its substantially cylindrical shape. This is important for the successful use of the anti-tip device to be described hereinafter.

Referring now to FIGS. 15 and 16 of the drawings, it is seen that sections of the rail and panel connector units 62 may be joined together to form a track and deck assembly of any desired length. For this purpose, both ends of each of the rail sections 65 are provided with a longitudinally-extending bore 114 which is adapted to receive a split-end connecting pin 115. This arrangement enables the sections of rail to be quickly joined and accurately aligned to form a smooth extended track for the movable carriers. The invention also contemplates a self-tightening rail section joiner for securing the sections of rail together in a tight, abutting relationship. The rail section joiner comprises an elongated, channel-shaped member, indicated generally as 116, which is adapted to overlie threaded holes 117 provided at the ends of each section of rail. The holes 117 threadedly receive a pair of flathead machine screws, indicated generally as 118, which have a tapered head 119. These screws are referred to as "tapered head machine screws" in this specification and the claims thereof. The member 116 is provided with a pair of openings, indicated generally as 120, which have a center-to-center distance or spacing which is less than the center-to-center distance or spacing of the holes 117 in the track sections when the ends of the sections are abutting each other. Each of the openings 120 is broached in a lateral direction to widen the opening laterally at points 121 so that the openings have a lateral width which is greater than the longitudinal length thereof. This insures that only the laterally-extending rims 122 of the openings 120 will engage the tapered heads 119 of the screws as seen in FIG. 16. Accordingly, as the screws 118 are rotated to tighten them, the downward movement of each screw causes the tapered head 119 to bear against the rims 122 of the openings 120. This causes the two screws 118 to be moved closer together in the longitudinal direction thereby exerting a longitudinal force on the two track sections in the direction of the arrows 123 in FIG. 16 which causes the rail section ends to be forced together tightly and secures them in that position.

Figure 17:
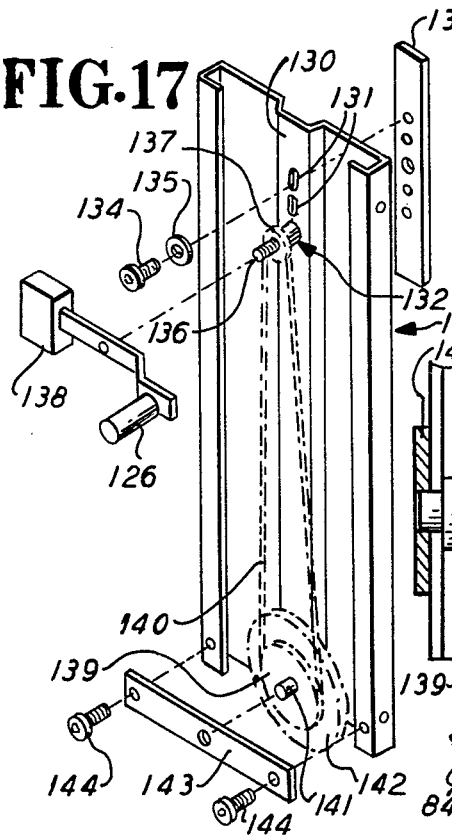
FIG. 17 is an exploded perspective view of a mechanical drive for the system with the front cover removed.
Figure 18:
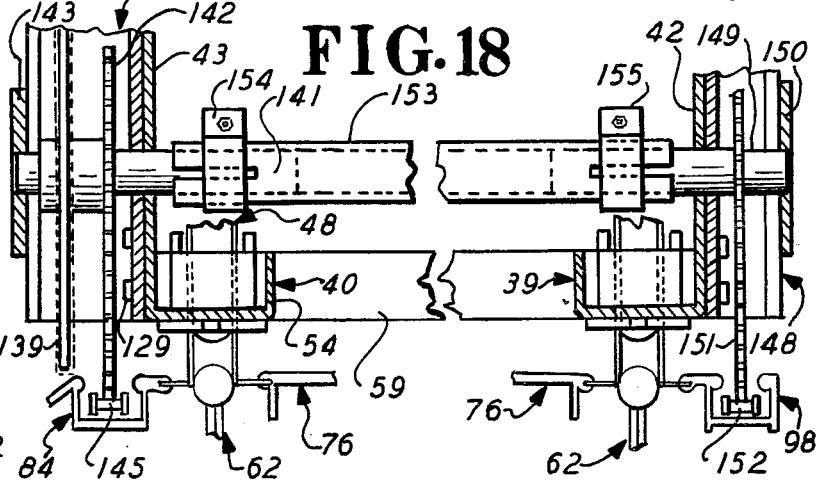
FIG. 18 is a vertical sectional view taken from the end of a movable carrier with the end frame of the carrier removed from convenience of illustration showing a double-ended mechanical drive connected to the movable carrier.

A mechanical drive, indicated generally as 124, is available for use with the storage system of the invention and is shown in FIG. 1 of the drawings as having a front cover 125, a drive handle 126 and a drive handle cover plate 127. As seen in FIGS. 4, 17 and 18, which show the drive without the front cover 125 and cover plate 127, a support member, indicated generally as 128, is bolted to the web portion 43 of the movable carrier frame member 40 by means of bolts 129. If desired, the top portion of the support member 128 may be bolted to the shelving sections 35 by bolts (not shown). A vertically-extending pad 130 having a vertically-disposed series of slots 131 formed therethrough is provided on the support member 128. A fixed, non-rotatable handle shaft, indicated generally as 132, has its inner end secured by means, such as welding, for example, to an elongated support plate 133 which fits into the depressed area behind the pad 130. The member 133 may be held in place against the support member 128 by a series of bolts 134 and washers 135. The outer end 136 of the handle shaft 132 is threaded to receive a nut (not shown) which is welded to the inner face of the handle cover plate 127 so that the cover is securely mounted on the shaft. The handle 126 is rotatably mounted on shaft 132 and is welded to sprocket gear 137 so that the handle and gear rotate together on the fixed shaft 132. The handle 126 is provided with a counterweight 138 to minimize the turning torque required.

The sprocket gear 137 is connected to a larger sprocket gear 139 by means of a chain 140. A rotatable shaft 141 is secured to the sprocket gear 139 and also to a pinion gear 142 so that both gears rotate together when handle 126 is rotated. The inner end of shaft 141 extends through and is supported by the pad 130 of the support member 128 and the web portion 43 of movable carrier frame member 40. The outer end of the shaft 141 is rotatably supported by a bearing plate 143 which is secured to the support member 128 by bolts 144. Finally, a longitudinally-extending and horizontally-disposed chain 145 is disposed in the recessed space 89 of the front molding 84 and is held in place at both ends thereof by threaded anchors 146 which are bolted to the front molding by bolts 147 as shown in FIG. 8 of the drawings.

The gear 142 and chain 145 act as a rack and pinion gearing arrangement so that as the handle 126 is rotated, the gear 142 will rotate and cause the movable carrier to move horizontally along the rails 65 of the system. Since all of the component parts of the mechanical drive 124 except the chain 145 are located within the enclosed support member 128 and since the chain 145 is disposed in the easily accessable recessed channel 89 of the front molding 84, it is apparent that a single-ended mechanical drive may be easily installed in the movable aisle storage system of the invention at any time even after the initial installation has been completed and the shelves of the system fully loaded with stored materials. The slots 131 in support member 128 permit the fixed shaft 132 to be moved vertically to adjust the tightness of the chain 140.

When the sections of shelving 35 extend in long rows from the front molding 84 to the rear molding 98 so that the movable carriers 31 and 32 are of substantial width, it is often desirable to provide a double-ended mechanical drive to handle heavy loads so that both sides of the movable carriers are propelled with the same force at the same time. In this arrangement, a support member, indicated generally at 148, which is similar to the support member 128 is similarly bolted to the movable carrier frame member 39 as seen in FIG. 18 and is provided with a rotatable shaft 149 which is supported by another bearing plate 150. A pinion gear 151 is mounted on the shaft 149 to be driven thereby and is arranged to engage a chain 152 which is secured to the recessed portion 103 of the rear molding 98 in the same manner as the front chain 145. The shaft 141, which is driven by the handle 126, is connected to the shaft 149 by a hollow connecting shaft 153 having split ends which receive clamping collars 154 and 155 so that as the handle is turned, both pinions 142 and 151 are turned to engage their respective chains 145 and 152.

The anti-tip device of the invention is shown in FIGS. 19 through 23 of the drawings wherein it is seen that a substantially rectangular anti-tip bar member, indicated generally as 156, is provided with a bolt hole 157 which permits the bar to be bolted to the web portion 59 of movable carrier frame members 37 and 38 by means of a bolt 158 which is received by one of the two holes 60 at the ends of the members 37 and 38. When the anti-tip bar is employed, the rubber bumpers 61 are usually bolted to the upper of the two bolt holes 60 and the anti-tip bar is bolted to the lower of the two holes. Adjacent the lower end of the bar 156, a substantially cylindrical bore 159 is provided between which extends through the bar along a first axis 160 which is perpendicular to the plane of the bar 156 as seen in FIG. 20. A channel opening having substantially parallel walls 161 extends from the end 162 of the bar to the bore 159 to bifurcate the bar. The walls 161 of this channel are parallel to a second axis 163 which lies at an acute angle with respect to bore hole axis 160 as seen in a horizontal plane. The diameter of the bore 159 is made larger than the diameter of the rail 65 to insure a sliding fit. The spacing between channel walls 161, however, may be made somewhat less than the diameter of the bore 159 but still slightly larger than the diameter of the rail 65, so that the bar may be slid downwardly in the direction of the arrow 164 in FIG. 23 to seat the bar on the rail. After the bar is seated, it is twisted in the direction of the arrow 165 which causes the first axis 160 of the bore 159 to become aligned with the axis of the rail 65, so that the bar is held in place and prevented from being removed by a vertical movement opposite in direction to the arrow 164. It will be noted that the relationship between the bore diameter, the channel width, the rail diameter and the acute angle between the bore and channel axes is such that the substantially cylindrical bore walls extend over an arc distance greater than 180° when viewed along the axis 160, so that the bar 156 cannot be removed from the rail when the bore axis 160 is aligned with the rail axis.

By virtue of this arrangement, the anti-tip bars 156 may be located at each corner of each of the movable carriers and are easily installed by dropping them in place over the rails and locking with a simple twisting movement. Once installed, however, the bars cannot be twisted accidentally in the opposite direction because they are bolted to the carrier by bolts 158. This arrangement permits the movable carriers to move horizontally along the rails without binding but prevents them from being tipped to dislodge the shelving thereon. When the anti-tip bars 156 are employed, the shelving sections 35 are bolted to the frame members of the movable carriers and the seal strips 78, 92 and 108 are removed from the deck assembly moldings. The anti-tip device of the invention may be installed after the initial installation of the storage system is completed and the shelves loaded since it merely involves removing the aforementioned seal strips.

The fixed carriers 33 and 34 shown in FIG. 1 of the drawings, may have the same construction as the movable carriers 31 and 32 except that the wheels 48 and the wheel housings 49 are omitted and replaced by a support assembly, indicated generally as 166, as shown in FIGS. 24 and 25 of the drawings. The support assembly 166 has a substantially flat flange portion 167 from which depends a pair of clamping arms 168 and 169 having substantially semi-cylindrical channels 170 formed therein which are adapted to engage the rail 65. The clamping arms 168 and 169 may be firmly secured together by tightening a nut 171 and a bolt 172 which extend through the arms in a direction transverse of the longitudinal axis of rail 65. The flange portion 167 is adapted to be secured by bolts 173 and nuts 174 to the flange portion 54' of the fixed carrier frame member 40'. The construction of the fixed carriers 33 and 34 are substantially the same as the construction of the movable carriers and reference numerals with a prime notation are used to identify the parts common to both. The same fixed carrier support assembly may be employed for all four corners of the fixed carrier frame to provide a firm, non-tippable support for the fixed carrier shelving units 36. Since the fixed carriers may have the same construction as the movable carriers, it will be noted that the fixed carrier support assemblies 166 are merely substituted for the wheel and housing assemblies of the movable carrier.

In some installations, the fixed carrier members 33 and 34 and the fixed shelving sections 36 are omitted so that it becomes necessary to install rail stops at the ends of the rails in the system to prevent the movable carriers from rolling off the ends of the track. The rail stops are shown in FIGS. 26 through 29 of the drawings as comprising a stop member, indicated generally as 175, and a bumper stop, indicated generally as 176. The stop member 175 is provided with separate clamping arms 177 and 178 which each have a curved channel 179 formed therein to engage the rail 65. The clamping arms 177 and 178 are bolted together by a bolt 180 which extends through the arms in a direction transverse to the longitudinal axis of the rail 65 and by a nut 181. The rubber stop bumper 176 is shown in FIG. 28 as being an integral unit, preferably formed of rubber, which has a pair of flexible depending arms 182 which are easily slipped over the cylindrical rail 65 to hold the bumper in place. As seen in FIG. 29, the seal strip 92 of the front deck molding 84 and the seal strip 78 of the deck molding 76 are adapted to engage the arms 177 and 178 of the stop member 175 and the sides of the stop bumper 176 to provide a completely sealed track opening to the ends of the tracks. When the track stop arrangement is used in lieu of the fixed carriers, a stop bar 183 is bolted to each end of the web portion 59 of the movable carrier members which face the ends of the rails by means of bolts 184 which engage the openings 60 of the carrier members as shown in FIGS. 2 and 3 of the drawings. The bar 183 has a length sufficient to enable it to hit the rubber stop bumper 176 when the movable carriers are at the ends of the rails to thereby prevent the carriers from rolling off the track and deck assembly. It will be noted, however, that when the anti-tip bars of the invention are employed on the movable carriers, the bumper bars 183 may be omitted since the anti-tip bars 156 will engage the rubber stop bumpers 176 and perform the same function.

It is believed apparent that many changes could be made in the construction and described uses of the foregoing movable aisle storage system and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A movable aisle storage system comprising
at least one deck panel;
a pair of rail and panel connector units disposed on opposite sides of said panel and extending along the length thereof, each of said units having
a rail portion, and
a support portion depending from said rail portion for support thereof, said support portion having
a support section shaped substantially as an inverted tee with the web of said tee depending substantially vertically from said rail portion, and
a pair of flange sections extending upwardly and outwardly from the ends of the arms of said tee, each of said flange sections having a substantially horizontally extending portion for supporting one side of a deck panel thereon to provide vertical load bearing support for the deck panel;
means for securing each side of said deck panel to said substantially horizontally extending portion of the adjacent flange section of the connector unit associated with that side; and
at least one movable carrier adapted to support storage equipment thereon, said carrier having wheels engaging said connector unit rail portions for rolling movement therealong.

2. A movable aisle storage system as claimed in claim 1 wherein said connector unit rail portion is substantially cylindrical.

3. A movable aisle storage system as claimed in claim 1 further comprising a longitudinally-extending levelling channel disposed beneath each of said rail and panel connector units with the web of the channel adapted to abut the floor upon which the storage system rests and the arms of the inverted tee-shaped support section of said connector unit support portion seated between the flanges of said channel; and a longitudinally-disposed series of levelling screws theadedly engaging the arms of said inverted tee-shaped support section and bearing against the web of said channel.

4. A movable aisle storage system as claimed in claim 3 further comprising a longitudinally-extending series of deck panel levelling devices disposed between said pair of rail and panel connector units in openings passing through said deck panel, each of said deck panel levelling devices having a propeller nut disposed in the panel opening associated therewith, and a deck panel levelling screw threadedly engaging said propeller nut.

5. A movable aisle storage system as claimed in claim 2 wherein longitudinally-extending sections of said rail and panel connector units are adapted to be interconnected to form an extended track, the ends of said longitudinally-extending sections of connector unit are provided with longitudinally-extending bores concentrically disposed within the cylindrical rail portion thereof, and split-end connector pins adapted to be disposed in said bores are provided to connect and align said longitudinally-extending connector unit sections.

6. A movable aisle storage system as claimed in claim 1 wherein the part of said connector unit rail portion which engages the wheels of the movable carrier is curved, and the curvature of the wheel race of each of the movable carrier wheels is substantially the same as the curvature of said rail portion part to prevent yawing of the movable carrier.

7. A movable aisle storage system as claimed in claim 6 further comprising flexible seal strips extending from the sides of said deck panel to the rail portion of said connector units to prevent debris from falling into the space between the rail portion of each connector unit and the adjacent side of said deck panel.

8. A movable aisle storage system as claimed in claim 1 wherein longitudinally-extending sections of said rail and panel connector units are adapted to be interconnected to form an extended track, said longitudinally-extending sections of connector unit are provided with oppositely-disposed threaded holes extending through the arms of the inverted tee-shaped support section thereof adjacent the ends of the longitudinally-extending sections, and self-tightening rail section joiners are provided for joining abutting ends of said longitudinally-extending connector unit sections, each of said rail section joiners having a pair of tapered head machine screws engaging said threaded holes at the abutting ends of said longitudinally-extending connector unit sections, and an elongated joiner member adapted to overlie the threaded holes of said abutting connector unit sections, said joiner member having a pair of openings extending therethrough for receiving said pair of screws, said openings having a center-to-center spacing which is less than the center-to-center spacing of the threaded holes of said abutting connector unit sections and a lateral width greater than the longitudinal length thereof, so that rotation of said screws to tighten them causes the tapered heads thereof to engage the laterally-extending rims of said openings thereby forcing the abutting section ends together.

9. A movable aisle storage system as claimed in claim 8 wherein said joiner member is substantially channel-shaped, said openings pass through the web of the joiner member, and the flanges of the joiner member abut the arms of the inverted tee-shaped support sections of the abutting longitudinally-extending sections of connector units.

10. A movable aisle storage system as claimed in claim 2 further comprising at least one anti-tip device for preventing tipping of said movable carrier, said device comprising an anti-tip member having a substantially cylindrical bore extending therethrough along a first axis, said bore being disposed adjacent one end of the member and having a diameter large enough to permit said cylindrical connector unit rail portion to slide therethrough, and a channel opening extending therethrough from said one member end to said bore to bifurcate the member, said channel opening extending along a second axis which is disposed at an acute angle with respect to said first axis and having a channel width greater than the diameter of said connector unit rail portion but less than the diameter of said bore, and means for mounting said member on said movable carrier with a connector unit rail portion disposed in said bore and said first axis aligned with the longitudinal axis of said connector unit rail portion.

11. A movable aisle storage system as claimed in claim 10 wherein said anti-tip member is an elongated bar having a bolt hole extending therethrough adjacent the other end thereof, the axis of said bolt hole being substantially parallel to said first bore axis, and said mounting means is a bolt passing through said bolt hole and engaging said movable carrier.

12. A movable aisle storage system as claimed in claim 2 wherein said connector unit rail portion is a cylindrical member, said connector unit support portion is a pair of back-to-back disposed members which contact each other and said rail member along a longitudinally-extending line, said back-to-back members being castellated along said line to form two series of staggered slots on opposite sides of said line, and said back-to-back members and said rail member are welded together to said slots, so that a single welding operation serves to join all three members and the weld material is disposed in said slots to preserve the substantially-cylindrical shape of the connector unit rail portion.

13. A movable aisle storage system as claimed in claim 1 wherein each of said movable carrier wheels is supported by a wheel housing comprising a pair of oppositely-disposed wheel support members, each of said wheel support members having a vertically-disposed support portion with an inwardly-projecting boss thereon, said boss having an axle hole extending therethrough, and a horizontally-disposed substantially C-shaped flange portion with inwardly-extending arms that cooperate with the arms of the flange portion of the other wheel support member to form open-ended slots therebetween, and an axle having a centrally-disposed enlarged shoulder portion upon which the wheel is mounted, the ends of said axle being disposed in the axle holes of said wheel support members and peened over to secure said support members thereto with said bosses bearing against the axle shoulder portion.

14. A movable aisle storage system as claimed in claim 13 wherein said movable carrier has a substantially rectangular frame with wheel slots formed therein to receive the support portions of the wheel housings, and bolt means provided for securing the flange portions of the wheel housings to the movable carrier frame, said bolt means being disposed in said open-ended slots so that the wheel housings may be slid into place before the bolts are tightened.

15. A movable aisle storage system as claimed in claim 1 further comprising a longitudinally-extending front panel molding having a substantially channel-shaped portion secured by the web thereof to the unused flange section of one of said rail and panel connector units selected as the front of the system, a downwardly-sloping apron depending from the front facing flange of said molding portion for sealing the front of the system, and a flexible seal strip extending from the other flange of said molding portion to the rail portion of said one connector unit for sealing the space between said front panel molding and the rail portion of said one connector unit; and a mechanical drive for rolling said movable carrier along the connector unit rail portions, said drive having a flexible chain longitudinally-disposed in said panel molding portion and secured to the web thereof to form a fixed rack, a pinion gear rotatably mounted on one side of said movable carrier and meshing with said chain, and handle means mounted on said one movable carrier side and coupled to said pinion gear for rotation thereof.

16. A movable aisle storage system as claimed in claim 15 further comprising a longitudinally-extending rear panel molding having a substantially channel-shaped portion secured by the web thereof to the unused flange section of the other of said rail and panel connector units selected as the rear of the system, a downwardly-extending apron depending from the rear facing flange of said rear panel molding portion for sealing the rear of the system, and a second flexible seal strip extending from the other flange of said rear panel molding portion to the rail portion of said other connector unit for sealing the space between said rear panel molding and the rail portion of said other connector unit;

a second flexible chain longitudinally-disposed in said rear panel molding portion and secured to the web thereof to form a second fixed rack;

a second pinion gear rotatably mounted on the other side of said movable carrier and meshing with said second chain; and shaft means interconnecting said second pinion gear with said first-named pinion gear for rotation therewith to form a double-ended mechanical drive.

17. A movable aisle storage system as claimed in claim 2 further comprising at least one fixed carrier adapted to support storage equipment thereon disposed at one end of said rail and panel connector units, said fixed carrier having a substantially rectangular frame, and fixed carrier mounting means for mounting said fixed carrier frame on said rail and panel connector units for support thereby, each of said fixed carrier mounting means having a flange portion secured to the underside of said fixed carrier frame, a bifurcated support portion depending from said fixed carrier mounting means flange portion, said bifurcated support portion having a pair of arms with curved channels thereon for engaging the cylindrical rail portion of said connector units, and means for securing said arms together to clamp the bifurcated support portion to the connector unit rail portion.

* * * * *